US007352975B2

(12) United States Patent
Fujiwara et al.

(10) Patent No.: US 7,352,975 B2
(45) Date of Patent: Apr. 1, 2008

(54) DEVELOPER SUPPLYING APPARATUS

(75) Inventors: Yukihiro Fujiwara, Toride (JP); Fumio Tazawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 11/218,508

(22) Filed: Sep. 6, 2005

(65) Prior Publication Data

US 2006/0051107 A1 Mar. 9, 2006

(30) Foreign Application Priority Data

Sep. 8, 2004 (JP) ..... 2004-260583

(51) Int. Cl.
*G03G 15/08* (2006.01)
*G03G 15/00* (2006.01)

(52) U.S. Cl. ..... 399/12; 399/262

(58) Field of Classification Search ..... 399/12, 399/258, 262

See application file for complete search history.

(56) References Cited

U.S. PATENT DOCUMENTS

| | | | | |
|---|---|---|---|---|
| 5,614,996 | A | 3/1997 | Tanda | |
| 5,761,586 | A * | 6/1998 | Kawashima et al. | 399/262 |
| 5,842,093 | A | 11/1998 | Tanda | |
| 5,848,342 | A | 12/1998 | Tanda | |
| 5,974,286 | A | 10/1999 | Ban et al. | 399/106 |
| 6,292,644 | B1 | 9/2001 | Goto et al. | 399/262 |
| 6,438,345 | B1 | 8/2002 | Ban et al. | 399/262 |
| 6,766,133 | B1 | 7/2004 | Ban et al. | 399/258 |
| 6,879,789 | B2 | 4/2005 | Yamada et al. | 399/106 |
| 6,947,690 | B2 | 9/2005 | Tazawa et al. | |
| 7,010,250 | B1 * | 3/2006 | Yahagi | 399/258 |
| 7,010,252 | B2 * | 3/2006 | Nozawa | 399/262 |
| 7,024,135 | B2 * | 4/2006 | Nagahama et al. | 399/262 |
| 2005/0008400 | A1 | 1/2005 | Tazawa et al. | 399/263 |
| 2005/0047818 | A1 | 3/2005 | Yamada et al. | 399/106 |
| 2005/0169672 | A1 | 8/2005 | Ban et al. | 399/258 |
| 2006/0008290 | A1 | 1/2006 | Yamada et al. | 399/106 |
| 2006/0034641 | A1 | 2/2006 | Yamada et al. | 399/258 |

FOREIGN PATENT DOCUMENTS

| | | |
|---|---|---|
| JP | 5-281855 A | 10/1993 |
| JP | 7-44000 | 2/1995 |
| JP | 7-168430 | 7/1995 |
| JP | 7-301992 A | 11/1995 |

(Continued)

*Primary Examiner*—Susan Lee
(74) *Attorney, Agent, or Firm*—Fitzpatrick, Cella, Harper & Scinto

(57) ABSTRACT

A developer supply apparatus includes a portion receiving a developer supply container and being movable between mounting/demounting and developer supply positions, a mechanism for moving the container receiving portion between its two positions by a manually operable lever, and a mounting discrimination member on the container receiving portion movable therewith and operatively connected with the lever and provided for relative movement between the mounting discrimination member and a portion to be discriminated provided on the developer supply container in interrelation with a moving operation of the lever. When the mounting discrimination member makes relative movement to reach a regular position, the container receiving portion moves to the developer supply position, and when the mounting discrimination member makes relative movement, and the discrimination member interferes with the portion to be discriminated before reaching the regular position, the container receiving portion is prevented from moving to the developer supply position.

6 Claims, 15 Drawing Sheets

FOREIGN PATENT DOCUMENTS

| | | | |
|---|---|---|---|
| JP | 8-62966 | A | 3/1996 |
| JP | 9-120205 | | 5/1997 |
| JP | 2000-131939 | A | 5/2000 |
| JP | 2002-311696 | A | 10/2002 |
| JP | 2003-295593 | A | 10/2003 |
| JP | 2004-138694 | A | 5/2004 |
| JP | 2004-163639 | A | 6/2004 |

* cited by examiner (a)

(b)

DEVELOPER SUPPLYING APPARATUS

FIELD OF THE INVENTION AND RELATED ART

The present invention relates to a developer supplying apparatus ensuring that a mistake regarding the color and type of the developer stored in the developer container does not occur when mounting a developer supply container into the developer supplying apparatus of an electrophotographic image forming apparatus such as a copying machine, a printer, etc.

Developers in the form of a minuscule particle have long been used by an electrophotographic image forming apparatus such as an electrophotographic copying machine, a printer, etc. Thus, it has been a common practice to supply the main assembly of an electrophotographic image forming apparatus with developer, with the use of a developer supply container, as the amount of the developer in the main assembly of the electrophotographic image forming apparatus reduces to a critical level by consumption. In recent years, efforts have been made to make a developer supply container commonly usable among the main assembly of various image forming apparatuses, for cost reduction. However, complete success in making a developer supply container commonly usable among the various image forming apparatuses has a side effect: a developer supply container containing a developer of a particular color or type can sometimes be accidentally mounted in an image forming apparatus designed for a developer of another color or type.

Therefore, various means have been taken in order to prevent the mistake that a given developer container containing a developer with certain properties is mounted in the main assembly of an image forming apparatus designed for a developer different in properties from the developer in the given developer container. For example, the main assembly of a given image forming apparatus is provided with a portion with a recess, and a developer supply container therefor is provided with a portion with a projection matching the recess of the main assembly, in order to make noninterchangeable two developer supply containers different in the type of developer therein (Patent Document 1: Japanese Laid-open Patent Application 9-120205).

Developer is in the form of an extremely minuscule particle. In recent years, therefore, in order to prevent developer from scattering during a developer supplying operation, a method in which a developer supply container is set in the main assembly of an image forming apparatus, and the developer therein is discharged little by little from a smaller opening of the developer supply container has come to be widely used.

As an example of such a developer supplying method, it has been proposed to employ a roughly cylindrical bottle, as a developer supply container, structured so that it can be kept in the main assembly of an image forming apparatus, and also, so that as the container proper of the developer supply container receives driving force from the main assembly, it conveys the developer therein and discharges the developer therein (Patent Document 2: Japanese Laid-open Patent Application 7-44000).

However, the employment of the method of preventing the above described developer container replacement error with the use of the method disclosed in Patent Document 1, that is, the simple combination of a recess and a projection, as the method for preventing the developer container replacement error when using the developer supplying method, disclosed in the above described Patent Document 2, which rotates a developer supply container to convey and discharge the developer therein, has the following problem: After the mounting of the developer supply container into the main assembly of an image forming apparatus, the developer supply container is rotated relative to the main assembly, and therefore, when the developer container needs to be removed to be replaced with another one, it must be properly positioned (rotated) by a user in order to align the recess and projection which are for preventing the accidental mounting of a wrong developer container. This invites a reduction in operational efficiency.

Further, as a means for preventing the reduction in operational efficiency, it is possible to provide the main assembly of an image forming apparatus with a mechanism for controlling the rotation of a developer supply container, so that the aforementioned recess and projection, as means for preventing the mounting of a wrong developer supply container, automatically align with each other when a user mounts or removes a developer supply container. However, providing the main assembly of an image forming apparatus with such a mechanism complicates the main assembly, and also, increases its cost. In other words, such a structural arrangement cannot be said to be a decisive means.

Further, a method, such as the one disclosed in Japanese Laid-open Patent Application 7-168430, for preventing the mounting of a wrong developer supply container, by making a developer supply container for a developer of a specific color or type different from a developer supply container for a developer of another color or type, in terms of the position of the projection, on the surface of the leading end portion of the container, for transmitting driving force, has been proposed as the means for overcoming the above described problem. However, this method also cannot be said to be a perfect one in terms of ease of operation and operational efficiency, because the employment of this method makes it difficult for a user to notice the error being made by the user, when the user accidentally attempts to mount a developer supply container containing a developer of a wrong color, into the main assembly of an image forming apparatus.

SUMMARY OF THE INVENTION

The primary object of the present invention is to provide a developer supplying apparatus, which is simple in structure, and yet, ensures that a developer supply container is easily and reliably mounted.

A developer supplying apparatus for accomplishing the above object comprises:

a developer supply container tray movable, while holding a developer supply container containing developer supply, between the location for mounting or removing a developer supply container and the location for supplying developer;

a mechanism which can be made, by the movement of a lever operable by a user, to move the developer supply container tray between the location for mounting or removing a developer supply container and the location for supplying developer; and a developer supply container compatibility checking member which is attached to the developer supply container tray so that it moves with the tray, and the movement of which is controlled by the abovementioned lever so that as the lever is moved, it is moved to, or away from, the developer supply container identification portion of a developer supply container, by the movement of the lever;

wherein as the movement of the developer supply container compatibility checking member which moves relative to the developer supply container identification portion is interfered with by the developer supply container identification portion before the developer supply container compatibility checking member reaches the normal position, the developer supply container tray is prevented from moving into the developer supplying location.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Next, the developer supplying apparatus in the first embodiment of the present invention will be described in detail along with an image forming apparatus employing this developer supplying apparatus, and a developer supply container, with reference to the appended drawings.

[Electrophotographic Image Forming Apparatus]

Figure 1:
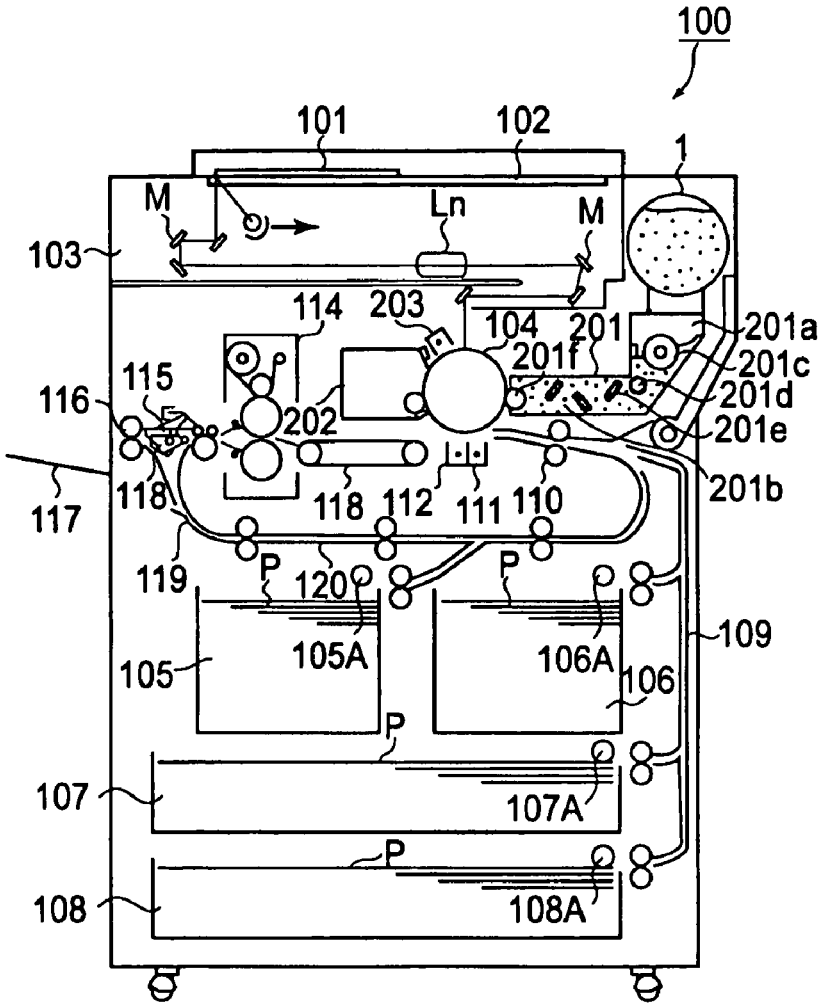
FIG. 1 is a sectional view of the image forming apparatus.

First, referring to FIG. 1, an electrophotographic copying apparatus, as an example of an electrophotographic image forming apparatus, employing the developer supplying apparatus in this embodiment will be described regarding its structure.

In the drawing, designated by a referential symbol 100 is the main assembly of an electrophotographic copying machine (which hereinafter will be referred to simply as apparatus main assembly). Designated by a referential symbol 101 is an original, which is placed on an original placement glass platen 102. An optical image reflecting the image data is formed on the peripheral surface of an electrophotographic photosensitive drum 104 as an image bearing member, by multiple mirrors and a lens Ln. Designated by referential symbols 105-108 are cassettes. Among these cassettes 105-108, the one containing the recording sheets P optimal for the intended image formation is selected according to the information inputted by a user through the control panel 100*a*, or the size of the original. As for the type of recording medium, it is not limited to recording paper; it is optional. For example, it may be OHP sheet or the like.

The recording medium is conveyed to the image forming means by the conveying means. More specifically, after being fed into the main assembly 100, and conveyed further in the main assembly 100, by one of the feeding-separating apparatuses 105A-108A, each recording medium P is conveyed to a pair of registration rollers 110 by way of a conveying portion 109. Then, it is conveyed further by a pair of registration rollers 110 in synchronism with the rotation of the photosensitive drum 104 and scanning timing of the optical portion 103. The devices designated by referential symbols 111 and 112 are a transfer discharging device and a separation discharging device, respectively. An image formed of developer (which hereinafter will be referred to simply as developer image) on the photosensitive drum 104 is transferred onto the recording medium P by the transfer discharging device 111, and the separation discharging device 112 separates the recording medium P from the photosensitive drum 104 after the transfer of the developer image onto the recording medium P.

Thereafter, the recording medium P is conveyed further by the conveying portion 113. Then, in the fixing portion 114, the developer image on the recording medium P is fixed by heat and pressure. Next, when the image forming apparatus is in the single-sided copy mode, the recording medium P is conveyed past the discharging-reversing portion 115, and then, is discharged into the delivery tray 117 by a pair of discharge rollers 116. When the image forming apparatus is in the two-sided copy mode, the flapper 118 of the discharging-reversing portion 115 is controlled so that the recording medium P is conveyed to the registration rollers 110 by way of the re-feeding conveyance paths 119 and 120. Then, the recording medium P is conveyed through the same path as that through which it is conveyed when in the single-sided copy mode, and then, is discharged into the delivery tray 117.

When in the multilayer copy mode, the recording medium P is conveyed through the discharging-reversing portion until the recording medium P is partially discharged out of the apparatus main assembly 100. That is, the recording medium P is stopped while the trailing end portion of the recording medium P remains between the pair of discharge rollers 116 after passing by the flapper 118. Then, in this condition, the flapper 118 is controlled and the pair of discharge rollers 116 are rotated in reverse. As a result, the recording medium P is conveyed back into the apparatus main assembly 100. Thereafter, the recording medium P is conveyed to the registration rollers 110 by way of the re-feeding conveyance paths 119 and 120. Then, it is conveyed through the same path as that through which it is conveyed when in the single-sided copy mode, and then, is discharged into the delivery tray 117.

In the apparatus main assembly 100, a developing portion 201, a cleaner portion 202, a primary charging device 203, etc., are disposed around the peripheral surface of the photosensitive drum 104, making up an image forming means. The developing portion 201 is a portion that develops, with the use of developer, an electrostatic latent image formed on the photosensitive drum 104 by an optical portion 103 based on the data extracted from the original 101. A developer supply container 1 for supplying the developing portion 201 with developer, and the apparatus main assembly 100, are structured so that the former is removably mountable in the latter by a user.

The developing portion has a development hopper 201*a* and a developing device 201*b*. The developer hopper 201*a* has a stirring member 201*c* for stirring the developer supplied from the developer supply container 1. After being stirred by this stirring member 201*c*, the developer is sent to the developing device 201*b* by a magnetic roller 201*d*. The developing device 201*b* has a development roller 201*f* and a sending member 201*e*. After being sent from the developer hopper 201*a* by the magnetic roller 201*d*, the developer is sent by the sending member 201*e* to the development roller 201*f*, by which it is supplied to the photosensitive drum 104.

The cleaner portion 202 is for removing the developer remaining on the photosensitive drum 104. The primary charging device 203 is for charging the photosensitive drum 104.

[Developer Supplying Apparatus]

Figure 2:
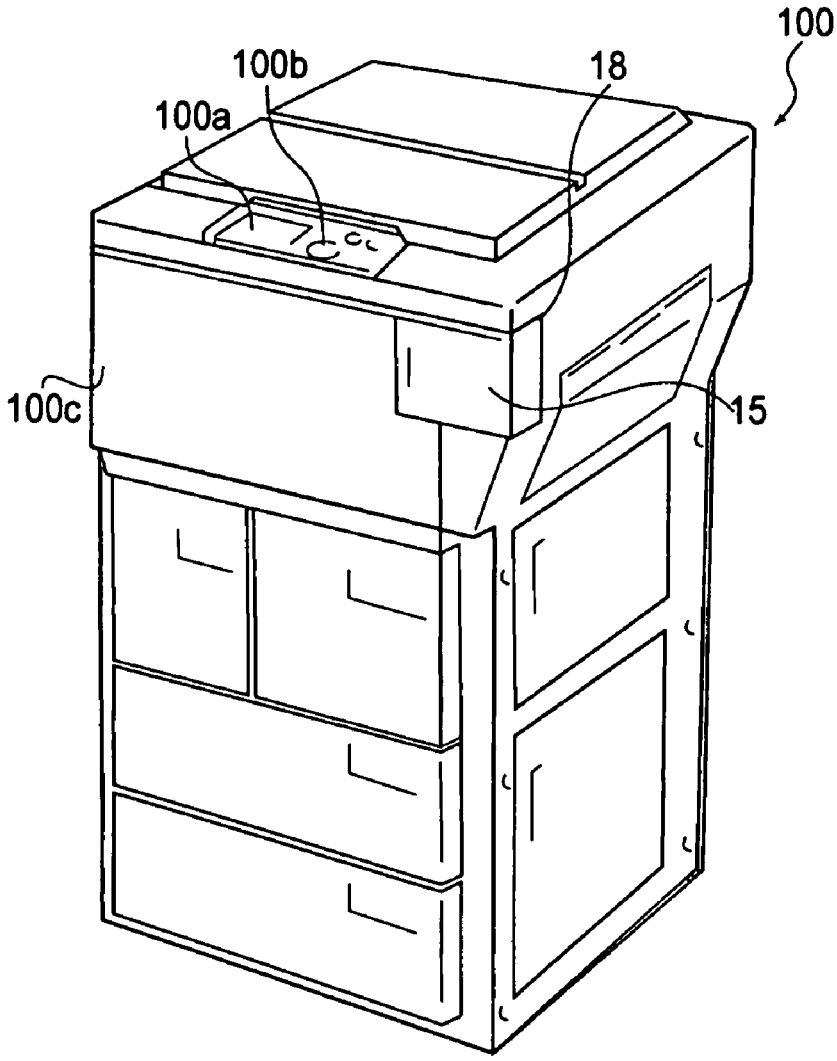
FIG. 2 is a perspective view of the image forming apparatus.
Figure 3:
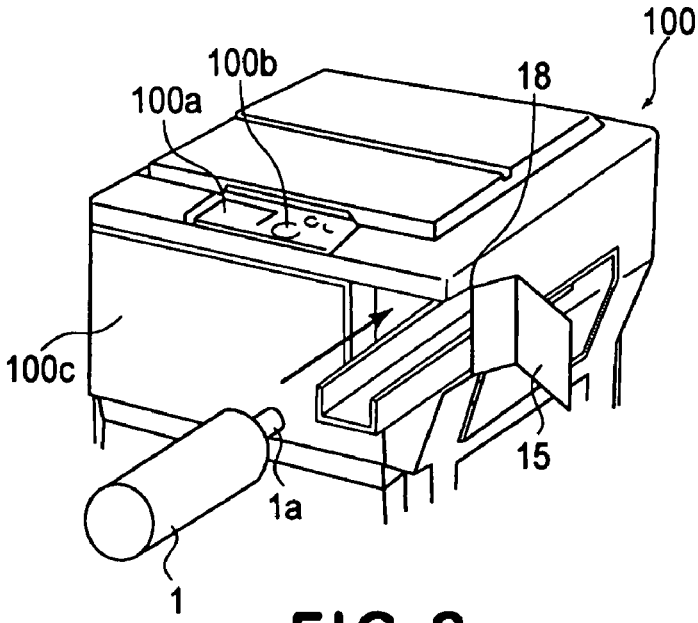
FIG. 3 is a perspective drawing showing the operation for mounting the developer supply container into the main assembly of the image forming apparatus.
Figure 5:
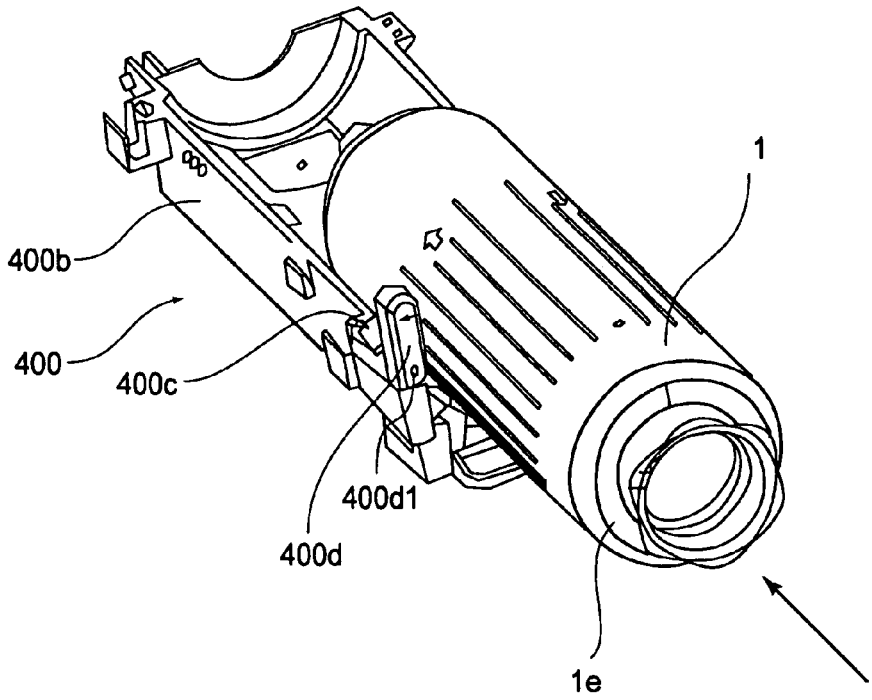
FIG. 5 is a perspective view showing the operation to mount the developer supply container into the developer supplying apparatus.

Next, the developer supplying apparatus will be described with reference to drawings. As a developer supply container replacement cover 15 (which hereinafter will be referred to as "container replacement cover"), which is a part of the external cover shown in FIG. 2, is opened by a user as shown in FIG. 3, it becomes possible to access the developer supplying apparatus 400 (FIG. 5). The image forming apparatus is structured so that the apparatus main assembly 100 can be supplied with developer by removably mounting the developer supply container 1, which will be described later, into the developer supplying apparatus 400.

Figure 4:
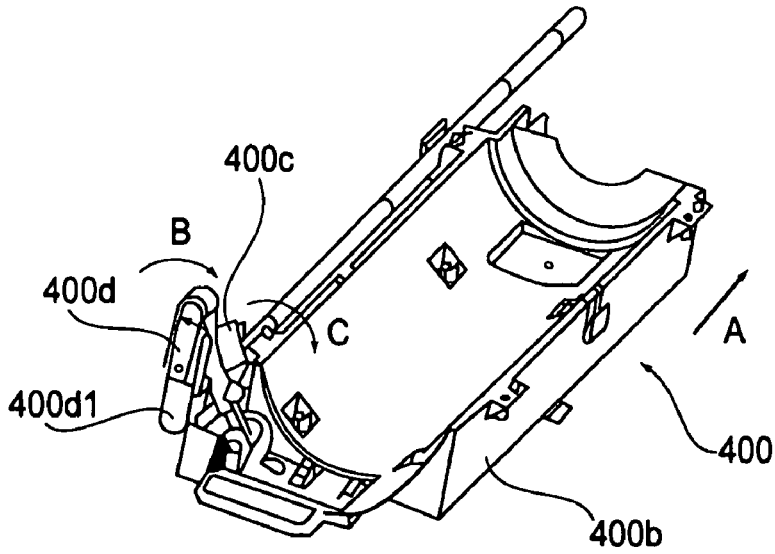
FIG. 4 is a perspective view of the developer supplying apparatus.
Figure 6:
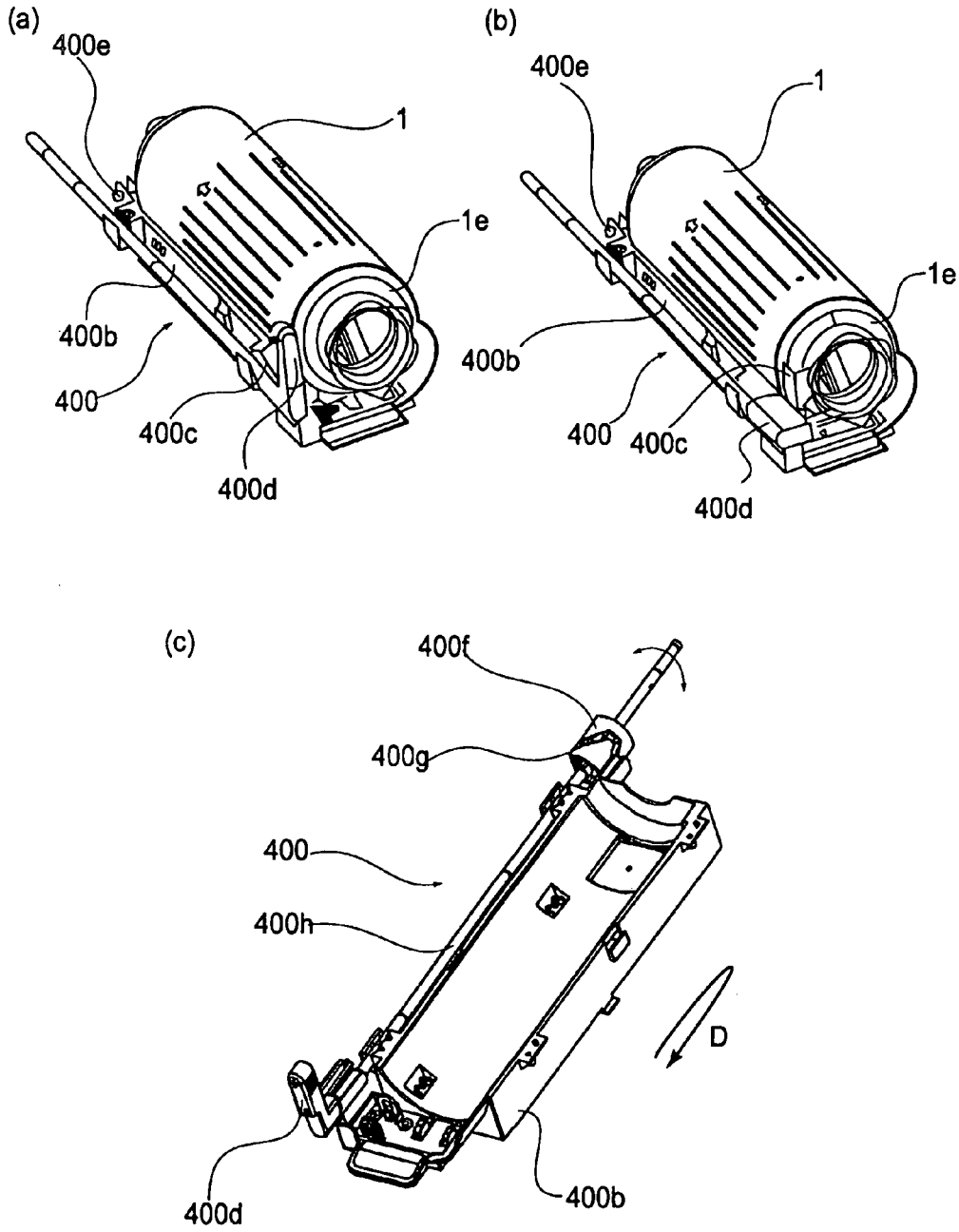
FIG. 6 is a drawing showing the mechanism for moving the developer supply container tray.

At this time, referring to FIGS. 4-6, the structure of the developer supplying apparatus 400 will be described. FIG. 4 is a perspective view depicting the developer supplying apparatus 400 alone, and FIG. 5 is a perspective view of the developer supplying apparatus 400 in the apparatus main assembly 100, and the developer supply container 1, which is being mounted into the developer supplying apparatus 400. FIG. 6 is a perspective view of the developer supplying apparatus 400 and developer supply container 1 after the insertion of the latter into the former, FIG. 6(*a*) showing their state prior to the operation of the rotatable lever 400*d*, which will be described later, and FIG. 6(*b*) showing their state after the operation of the rotatable lever 400*d*, that is, the completion of the process of mounting the latter into the former.

Referring to FIG. 4, the developer supplying apparatus 400 is structured so that the developer supply container tray 400*b*, into which the developer supply container 1 is to be set when it is mounted into the developer supplying apparatus 400, is movable in the direction indicated by an arrow mark A (direction in which developer supply container is to be inserted). The developer supplying apparatus 400 is provided with the rotatable lever 400*d*, which can be rotated about the axle 400*d*1. The abovementioned developer supply container tray 400*b* is movable in the arrow mark A direction by rotating the rotatable lever 400*d* in the direction indicated by an arrow mark B.

Next, referring to FIGS. 4-6, in order to mount the developer supply container 1, the developer supply container 1 is to be placed on the developer supply container tray 400*b*, and the rotatable lever 400*d* is to be rotated. As the rotatable lever 400*d* is rotated, the developer supply container tray 400*b* reciprocally moves, causing the developer supply container 1 to engage with the driving portion of the developer supplying apparatus 400, as will be described later. On the other hand, in order to remove the developer supply container 1, the rotatable lever 400*d* is also to be rotated. As it is rotated, the developer supply container tray 400*b* reciprocally moves, breaking the engagement between the developer supply container 1 and the driving portion of the developer supplying apparatus 400. As a result, it becomes possible to remove the developer supply container 1 from the developer supply container tray 400*b*. The structure related to these sequences will be described later in detail.

At this time, referring to FIG. 6, the reciprocal movement of the developer supply container tray 400*b*, which occurs as the rotatable lever 400*d* is rotated, will be described. Referring to FIG. 6(*c*), the rotatable lever 400*d* is connected to a rotatable shaft 400*h*, to which a slider cam 400*f* is connected. The slider cam 400*f* is provided with a cam groove 400*g*. Referring to FIG. 6(*a*), the developer supply container tray 400*b* is provided with an engagement portion 400*e*, which engages with the cam groove 400*g*. As the rotatable lever 400*d* is rotated, the slider cam 400*f* also rotates at the same time, causing the engagement portion 400*e* to move along the cam groove 400*f*. Consequently, the developer supply container tray 400*b* is reciprocally moved as indicated by an arrow mark D.

Further, the developer supply container tray 400*b*, which is movable as described above, is provided with a rotatable member 400*c* for checking whether or not the developer supply container 1 in the developer supply container tray 400*b* is compatible with the main assembly of the image forming apparatus (this member hereinafter will be referred to as compatibility checking member). The compatibility checking member 400*c* is also connected to the aforementioned rotatable lever 400*d*. Thus, as the rotatable lever 400*d* is rotated in the direction indicated by the arrow mark B in FIG. 4, not only does the developer supply container tray 400*b* moves, but also, the compatibility checking member 400*c* moves while rotating in the direction indicated by an arrow mark C.

In other words, the developer supplying apparatus 400 is structured so that the rotatable lever 400*d*, developer supply container tray 400*b*, and compatibility checking member 400*c* are tied to each other in terms of their movements, so that not only does the rotation of the rotatable lever 400*d* causes the developer supply container tray 400*b* to reciprocally move, but also, it causes the compatibility checking member 400*c* to rotate while reciprocally moving. As for the mechanical linkages among these components, any of the known mechanisms may be employed.

As described above, the movable developer supply container tray 400*b* is provided with a compatibility checking member 400*c* structured to reciprocally move with the developer supply container tray 400*b*. Therefore, the positional accuracy of the compatibility checking member 400*c* relative to the developer supply container identification portion of the developer supply container 1 is improved with the use of the simple structural arrangement. If the compatibility checking member 400*c* is attached to the main assembly itself, it is necessary for the compatibility checking member 400*c* to interfere with the container identification portion of the developer supply container 1 at the moment when the positional relationship between the compatibility checking member 400*c* and container identification portion of the developer supply container 1 becomes a predetermined one while the developer supply container 1 is moving. Therefore, it becomes necessary to improve the main assembly in overall rigidity, or employ a more complicated structural arrangement.

The aforementioned compatibility checking member 400*c* is positioned at the most upstream side, in terms of the direction in which the developer supply container 1 is inserted into the apparatus main assembly 100, where the developer supply container 1 is visible when the developer supply container 1 is replaced.

The compatibility checking member 400*c* is also provided with a notch, which will be described later. Unless this notch aligns with the developer supply container identification portion (which hereinafter will be referred to as container identification portion) with which the developer supply container 1 is provided, the rotating compatibility checking member 400*c* interferes with the developer supply container 1, being thereby preventing from rotating further, and therefore, the rotation of the rotatable lever 400*d* and the movement of the developer supply container tray 400*b*, which are tied to the rotational movement of the compatibility checking member 400*c*, are also regulated. With the provision of this structural arrangement, if an attempt is made to mount a developer supply container, which does not match the apparatus main assembly of a given image forming apparatus, into the given image forming apparatus, it will surely fail. The details of this structural arrangement will be described later in more detail.

[Developer Supply Container]

Figure 7:
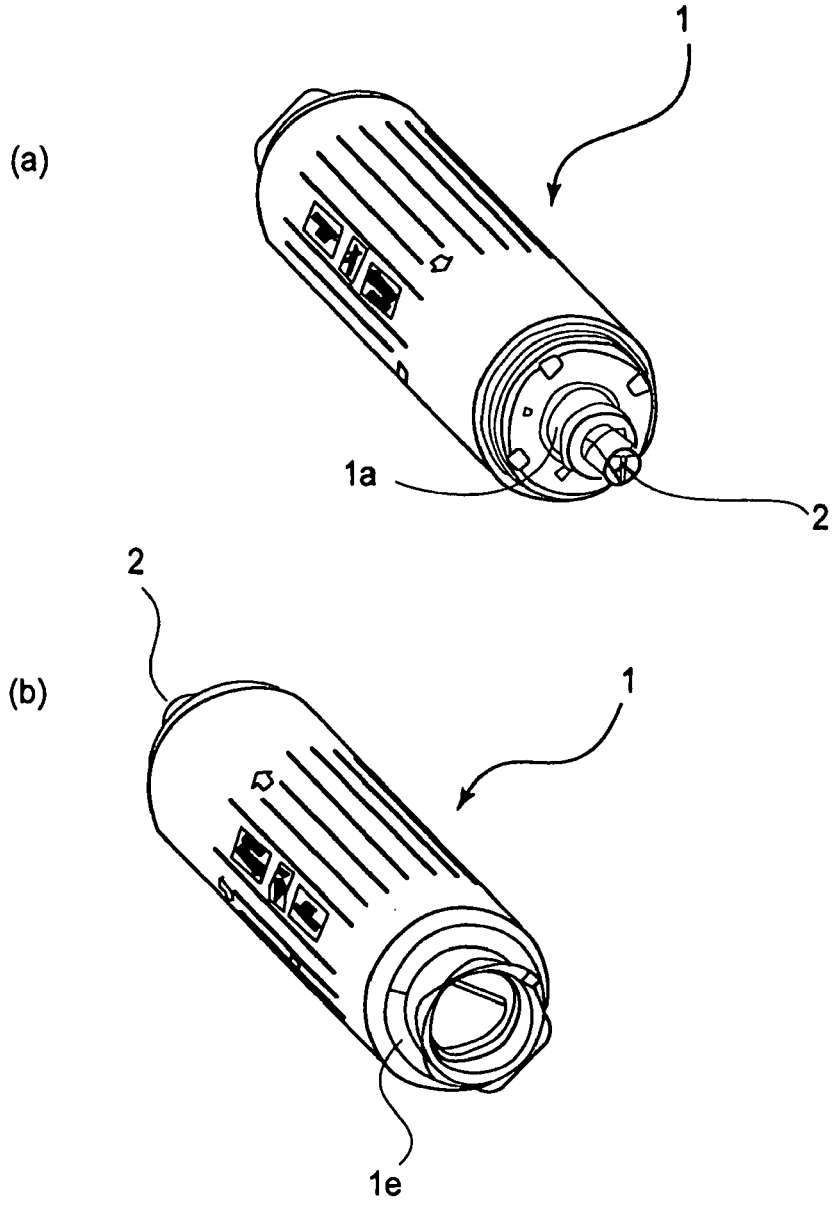
FIG. 7 is a perspective view of the developer supply container.
Figure 8:
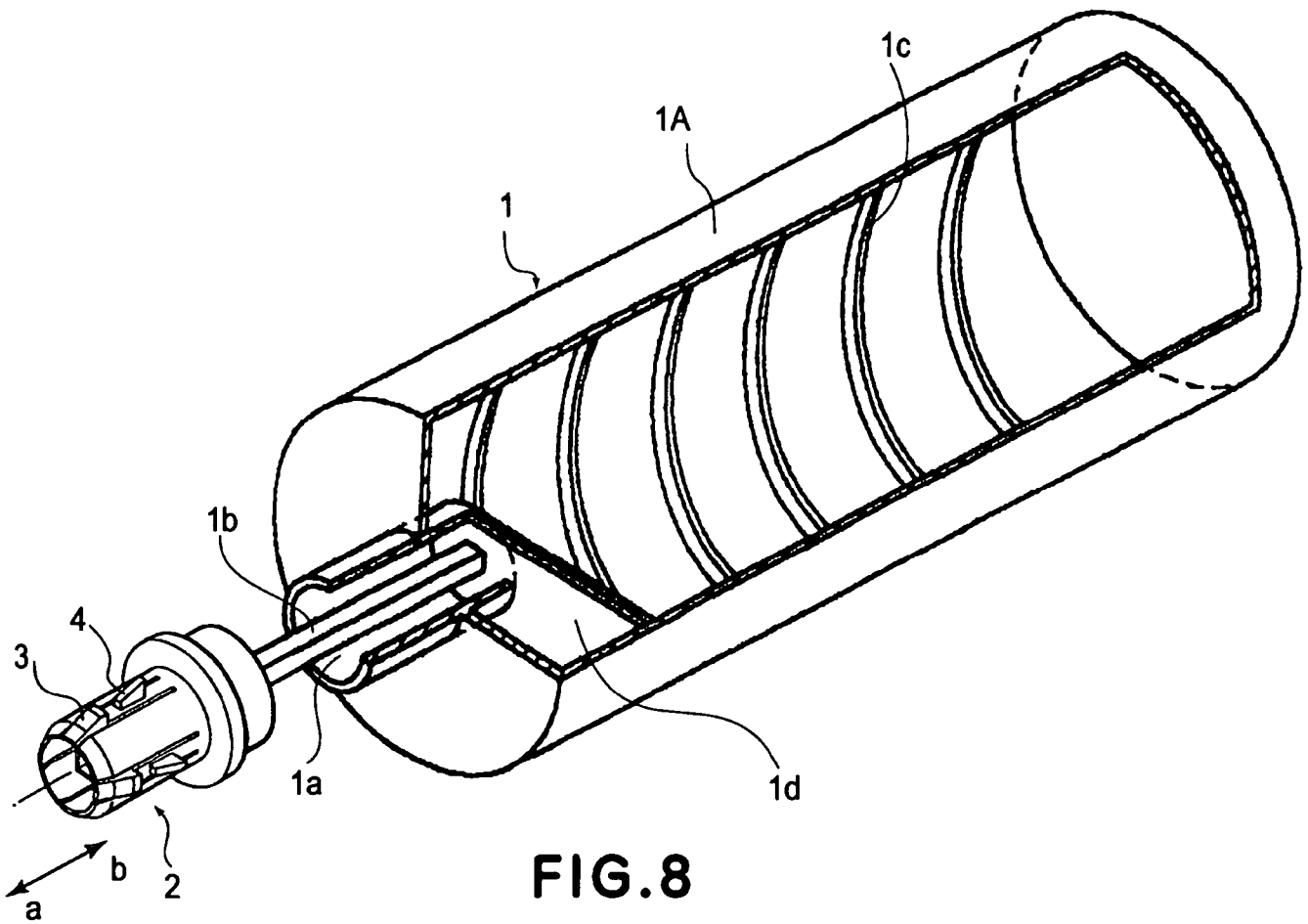
FIG. 8 is a perspective cut-away view of the developer supply container, the conveying-discharging means of which is a spiral rib.
Figure 9:
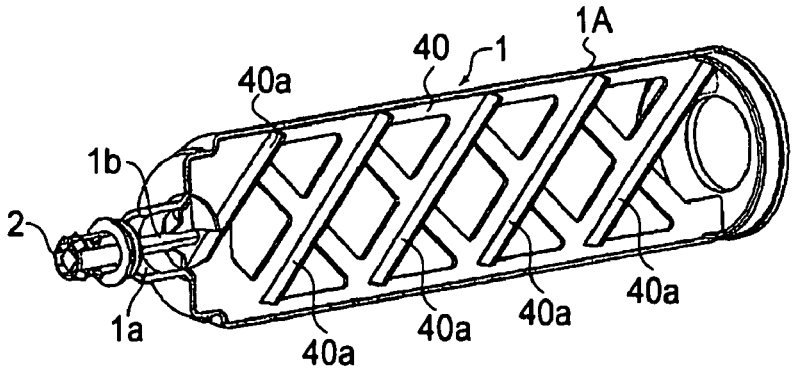
FIG. 9 is a perspective cut-away view of the developer supply container, the conveying-discharging means of which is a baffling member.

Next, referring to FIGS. 7-9, the developer supply container in this embodiment will be described. FIG. 7(*a*) is a perspective view of the developer supply container 1 as seen from the outlet 1*a* side of the developer supply container 1, and FIG. 7(*b*) is a perspective view of the developer supply container 1 as seen from the direction opposite to the direction in which the developer supply container 1 is seen in FIG. 7(*a*). FIG. 8 is a perspective cut-away view of the developer supply container 1, the conveying-discharging means in which is a spiral rib, and FIG. 9 is a perspective cut-away view of the developer supply container 1, the conveying-discharging means in which is a baffling member 40.

The baffling member 40 is provided with: a lifting portion which lifts the developer in the developer supply container 1 as the container 1 is rotated; a guiding portion which guides the developer lifted by the abovementioned lifting portion, downward and toward the outlet of the container 1; and a hole through which a part of the lifted developer is allowed to fall without being conveyed toward the aforementioned outlet of the container 1.

As for the shape of the developer supply container 1, it is roughly cylindrical. The developer supply container 1 is provided with an outlet portion 1*a*, which is smaller in diameter than the container proper, that is, the cylindrical portion 1A, and projects outward from the center of one of the end surfaces of the container proper. The outlet portion 1*a* is provided with a sealing member 2 for keeping the outlet 1*a* sealed. As will be better understood after the description, related to FIG. 7, which will be given later, the developer supply container 1 is structured so that as this sealing member 2 is slid in the direction parallel to the rotational axis (indicated by bidirectional arrow mark a-b in FIG. 8), the outlet 1*a* is opened or closed.

Figure 11:
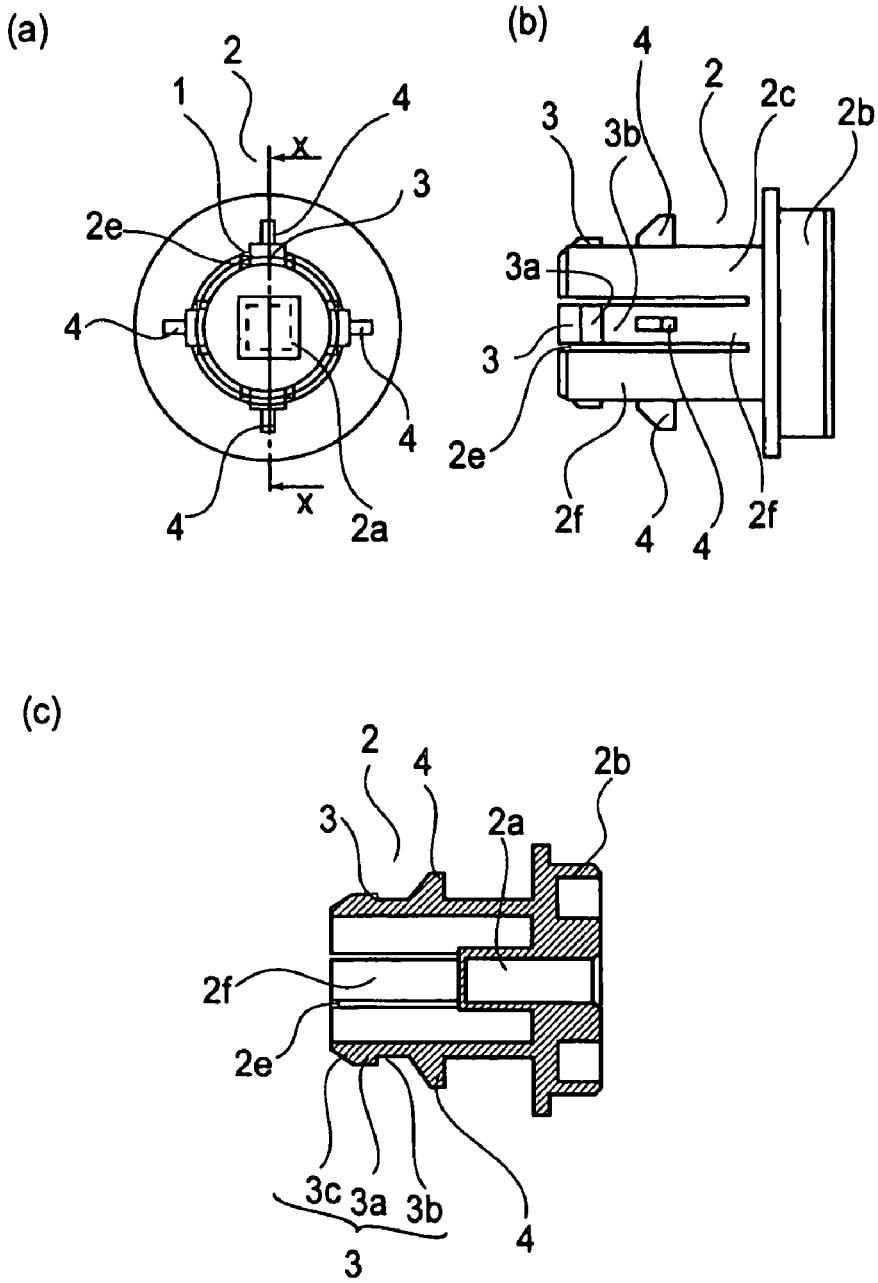
FIG. 11 is a drawing depicting the sealing member.

The sealing member 2 is provided with an elastically deformable engagement projection 3, which constitutes the end portion of the sealing member 2, and an engagement breaking portion 4 (which hereinafter will be referred to as disengagement portion) (FIG. 11). This engagement projection 3 is structured so that it engages with a driving portion 20 to perform the function of transmitting rotational driving force to the developer supply container 1. The structures of the engagement projection 3 and disengagement portion 4 will be described later in detail.

Next, the internal structure of the developer supply container 1 will be described. As described above, the developer supply container 1 has a roughly cylindrical shape. It is structured so that it is roughly horizontally disposed in the apparatus main assembly 100, and is rotated by the rotational driving force it receives from the apparatus main assembly 100. Referring to FIG. 8, the internal surface of the developer supply container 1 is provided with a spiral rib 1*c*. Thus, as the developer supply container 1 rotates, the developer is conveyed in the direction parallel to the axial line, following this spiral rib 1*c*, being thereby eventually discharged from the developer supply container 1 through the outlet 1*a*, with which one of the end walls of the developer supply container 1 is provided.

Referring to FIG. 7, the developer supply container 1 is provided with the container identification portion, which is on the rear end side, or the side opposite to the outlet 1*a* side. In this embodiment, the abovementioned container identification is provided with one or more mounting identification projections 1*e* (FIG. 17), as container identifying portions to be detected, which project from the container proper. The structural arrangement is such that the container identification projections 1*e*, and the compatibility checking member 400*c* on the developer supplying apparatus 400, allow only the developer supply container containing the developer used by the apparatus main assembly 100, to be mounted in the apparatus main assembly 100. The details of this structural arrangement will be given in the section of this specification related to the method for replacing the developer supply container.

The shape and internal structure of the developer supply container 1 do not need to be limited to those in this embodiment, as long as the developer is discharged by the rotation of the developer supply container 1. In other words, the internal structure of the developer supply container 1 may be one of the widely known structures, such as the one in this embodiment, that is, the structure in which the spiral rib 1*c* is disposed in the bottle-shaped container proper, or the like.

For example, the internal structure of the developer supply container 1 may be one of the modifications of the one in this embodiment, such as the one shown in FIG. 9. In the case of the internal structure shown in FIG. 9, the baffling member 40 in the form of a piece of plate is disposed in the container proper, and the surfaces of the baffling member 40 are provided with multiple ribs 40*a* inclined relative to the axial line of the developer supply container 1. One end of one of these inclined ribs 40*a* extends to the outlet 1*a*. The developer in the container proper is delivered by these inclined ribs 40*a* to the outlet 1*a*, and is eventually discharged from the developer supply container 1 through the outlet 1*a*.

As for the principle based on which the developer is discharged, as the developer supply container 1 is rotated, the developer is scooped up by the baffling member 40, and slides down on the surfaces of the baffling member 40, while being conveyed forward (toward outlet 1*a*) of the developer supply container 1 by the inclined ribs 40*a*. As this process is repeated, the developer in the developer supply container 1 is gradually conveyed toward the outlet 1*a* while being stirred, and is eventually discharged from the developer supply container 1 through the outlet 1*a*.

As described above, one of the end surfaces of the cylindrical portion 1*a*, or the container proper, is provided with the outlet 1*a*, a drive shaft 1*b*, which is integral with the baffling member 40 and projects through the outlet 1*a*. The axial line of the drive shaft 1*b* roughly coincides with that of the outlet 1*a*. The drive shaft 1*b* fits in an engagement hole 2*a* (FIG. 11) of the sealing member 2. The drive shaft 1*b* is for transmitting rotational driving force from the apparatus main assembly 100 to the container proper 1*a* through the sealing member 2. Therefore, it is shaped so that its cross section becomes square, H-shaped, D-shaped, or the like, which enables the drive shaft 1*b* to transmit the rotational driving force. The baffling member 40 is solidly attached to the container proper 1A with the use of one of the widely known means.

Figure 10:
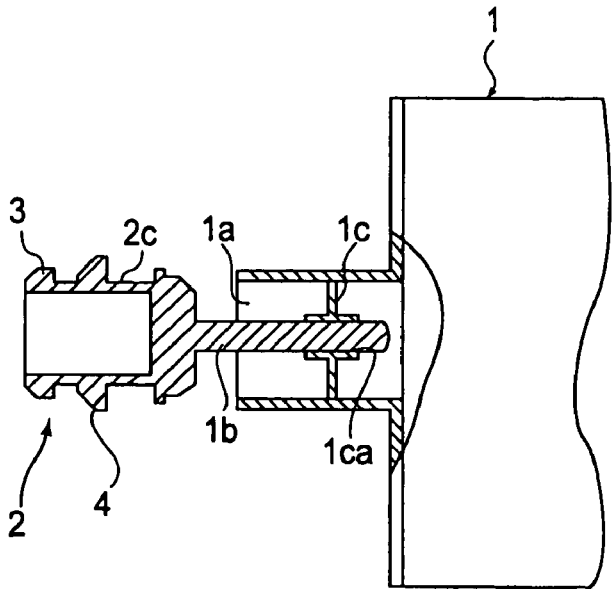
FIG. 10 is an enlarged sectional view of the driving force transmitting portion, the drive shaft of which is on the sealing member side.

It does not matter at all if the drive shaft 1 is rendered integral with the sealing member 2 as shown in FIG. 10, instead of being rendered integral with the baffling member 40. In such a case, it is necessary that a developer supply container 1 is provided with an engagement hole 1*ca* for transmitting the driving force from the drive shaft 1*b*. In the case of this modification, the structural member 1*c* of the outlet 1*a* is provided with the engagement hole 1*ca*.

[Sealing Member]

Figure 12:
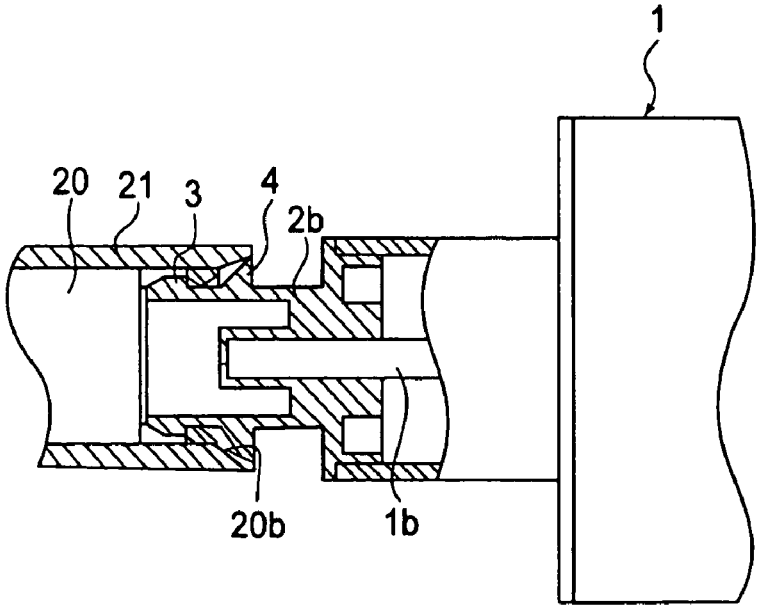
FIG. 12 is a sectional drawing showing the sealing member and driving portion, which are in engagement with each other.

Next, referring to FIGS. 11 and 12, the sealing member 2 will be described further. FIG. 11(*a*) is a front view of one of the embodiments of the sealing member 2 employed by the developer supply container 1 in this embodiment, and FIGS. 11(*b*) and 11(*b*) are side and sectional views of the same. FIG. 12 is a sectional view of the sealing member 2 and drive shaft 1*b*, which are fully engaged with each other.

Referring to FIGS. 11 and 12, the sealing member 2 is provided with a sealing portion 2*b* for sealing the outlet 1*a* of the developer supply container 1 in the unsealable fashion, and a cylindrical coupling portion 2*c* (driving force receiving portion) which engages with the driving portion 20 of the apparatus main assembly 100. The external diameter of the sealing portion 2*b* is set to a value greater by an appropriate amount than the internal diameter of the outlet 1*a*. Thus, the developer discharge opening of the outlet 1*a* can be hermetically sealed by pressing the sealing portion 2*b* into the outlet 1*a*.

As described above, the sealing member 2 has the engagement hole 2*a* which engages with the drive shaft 1*b* to transmit the driving force, which it receives from the apparatus main assembly 100, to the drive shaft 1*b*. This engagement hole 2*a* extends through the sealing portion 2*b* and driving force receiving portion 2*c*. It is given a polygonal cross-sectional shape, which matches the shape of the cross-section of the drive shaft 1*b* (square shape in this embodiment). It is rendered slightly larger in cross section than the drive shaft 1*b*, allowing thereby the drive shaft 1*b* to loosely fit into the engagement hole 2*a*.

Further, the drive shaft 1*b* and engagement hole 2*a* are structured so that as the drive shaft 1*b* is loosely fitted into the engagement hole 2*a* as described above, the cylindrical portion 1A of the developer supply container 1 and the sealing member 2 are engaged with each other in terms of the rotational direction of the cylindrical portion of the developer supply container 1, while being allowed to move relative to each other in the direction parallel to the axial direction. With the provision of this structural arrangement, when the developer supply container 1 is mounted into the developer supplying apparatus 400, the sealing member 2 and the container proper 1A of the developer supply container 1 are separable from each other; in other words, the developer delivery opening, that is, the opening of the outlet 1*a*, can be unsealed (opening of outlet can be exposed).

As for the length by which the engagement hole 2*a* and drive shaft 1*b* engage with each other, it is long enough to prevent the two from become completely disengaged when the sealing member 2 and the outlet 1*a* of the developer supply container 1 are separated from each other. With the provision of this structural arrangement, even after the separation of the sealing member 2 from the outlet 1*a* of the developer supply container 1, the drive shaft 1*b* can receive the driving force through the sealing member 2.

Next, the engagement projection 3 will be described in detail. The sealing member 2 is provided with the driving force receiving portion 2*c* for receiving the driving force from the apparatus main assembly 100, and the driving force receiving portion 2*c* is provided with the engagement projections 3. Each engagement projection 3 projects outward from the peripheral surface of the cylindrical sealing member 2, in the radius direction of the sealing member 2. It has a driving force receiving surface 3*a* for transmitting the rotational driving force, and an engagement surface 3*b* for keeping the sealing member 2 engaged with the driving portion of the apparatus main assembly 100 when separating the developer supply container 1 and sealing member 2 from each other. In other words, the engagement projection 3 performs two different functions: the rotational driving of the developer supply container 1 by the driving force receiving surface 3*a*, and the regulating of the position of the developer supply container 1 by the engagement surface 3*b*. With the employment of a structural arrangement such as this one, the operation for opening or closing the outlet 1*a*, and the transmission of the driving force, can be accomplished with a single component, that is, the sealing member 2, making it possible to provide a developer supply container which is compact, inexpensive, and simple in structure.

From the standpoint of component count reduction, it is basically desired that the engagement projections 3 are formed as integral parts of the sealing member 2. However, it does not matter if the engagement projections 3 are formed independently from the sealing member 2 and then, are attached to the sealing member 2. When forming the engagement projections 3 as integral parts of the sealing member 2, it is recommendable that the driving force receiving surface 3*a* of each engagement projection 3 is provided with a slit-like groove 2*e* to allow the engagement projection 3 to resiliently deform independently from the rest of the sealing member 2.

The reason for the above is that the driving force transmission, which will be described later, is stopped by displacing the engagement projections 3 by the action coming from the apparatus main assembly 100. Incidentally, in this embodiment, the engagement projections 3 are formed as integral parts of the sealing member 2. Further, the tip of each engagement projection 3 is given a tapered surface 3*c* in order to allow the sealing member 2 to be smoothly inserted into the driving portion 20 of the apparatus main assembly 100.

Next, referring again to FIGS. 11 and 12, the structure of the disengaging portion will be described. In this embodiment, the sealing member 2 is provided with four engagement projections 3, that is, two pairs of mutually opposing engagement projections 3. More specifically, the sealing member 2 is provided with four resiliently deformable supporting portions 2*f* which support the four engagement projections 3 one for one. Further, the sealing member 2 is provided with multiple disengagement portions 4, the number of which is the same as that of the engagement projections 3. More specifically, the four supporting portions 2*f*, which support the engagement portions 3, one for one, are also provided with the four disengagement portions 4 one for one. Each supporting portion 2*f* is sandwiched by a pair of slits 2*e*, in terms of the circumferential direction of the sealing member 2, allowing the engagement projection 3 and disengagement portion 4 (supporting portion 2*f*) to displace radially inward or outward of the sealing member 2. As the force being applied to the engagement portions 3 or disengagement portions 4 is removed, the supporting portions 2*f* (sealing member 2) spring back into their normal shapes. Thus, it is desired that the supporting portions 2*f* are rendered relatively thin to allow them to easily and resiliently deform, and also, that they are formed of a material suitable for giving them the abovementioned property.

A sealing member such as the above described sealing member 2 is desired to be manufactured of resin such as plastic with the use of injection molding. However, the material and manufacturing method for the sealing member may be different from those in this embodiment. Further, the sealing member 2 may be manufactured in multiple sections, which are to be joined to make up the sealing member 2. In order to hermetically seal the outlet 1*a* by pressing the sealing member 2 into the outlet 1*a*, the sealing member 2 is required to have a proper amount of elasticity. Thus, as the material for the sealing member 2, low density polyethylene is most desirable, and polypropylene, straight chain polyamide, Nylon (commercial name), high density polyethylene, ABS, HIPS (impact resistant polystyrene), etc., are the next to be preferably usable.

As described above, by forming the driving force receiving portion 2*c* and disengaging portion 4 of elastically deformable material, the elasticity of the two portions 2*c* and 4 can be utilized to make it possible for the driving portion 20 and driving force receiving portion 2*c* to easily engage with each other or disengage from each other. Further, since the materials listed above have a proper amount of elasticity, not only allowing the driving portion 20 and driving force receiving portion 2*c* to easily engage with each other or disengage from each other, but also, rendering the two portions 20 and 2*c* sufficiently durable. Further, the disengaging portions 4 are matched in number and position (in terms of circumferential direction) with the engagement projections 3. Therefore, the multiple engagement projections 3 are uniformly displaced, in terms of distance and direction, by the disengaging portions 4.

[Driving Force Receiving Portion]

Next, referring to FIG. 13, the structure of the driving force receiving portion 2*c* of the sealing member 2 of the developer supply container 1 in this embodiment will be described.

Figure 13:
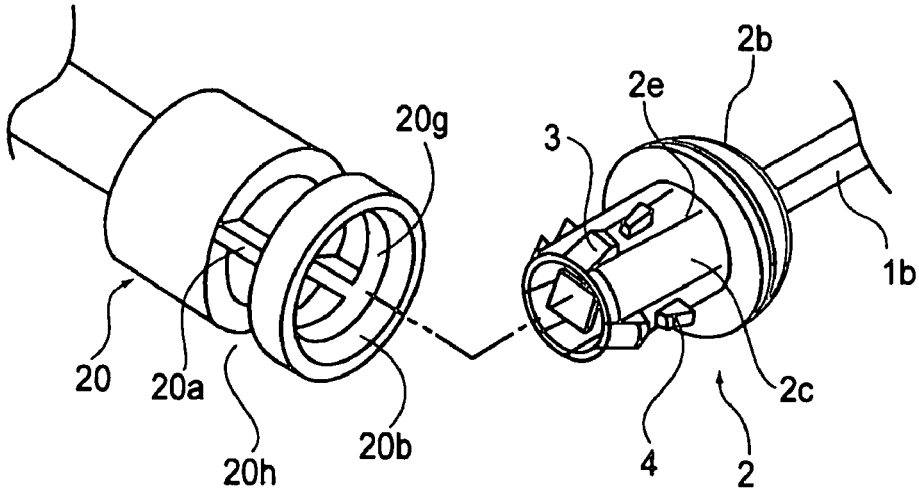
FIG. 13 is a perspective view depicting the driving force receiving portion.

FIG. 13 is a perspective view of the driving force transmitting portion of the main assembly of the image forming apparatus, and the driving force receiving portion of the sealing member 2, in this embodiment. In this embodiment, the sealing member 2 in this embodiment is provided with the cylindrical driving force receiving portion 2*c* for receiving the driving force from the driving portion 20 of the developer supplying apparatus 400. As described before, the cylindrical driving force receiving portion 2*c* of the sealing member 2 is provided with the two pairs of mutually opposing flexible engagement projections 3, which easily and resiliently displace as they are pressed.

On the other hand, the apparatus main assembly 100 is provided with the driving portion 20, which is structured to be engaged with the engagement projections 3 of the sealing member 2. More specifically, in order to allow the sealing member 2 to smoothly enter the driving portion 20, the inward side of the entrance portion of the driving portion 20 is chamfered, creating a surface 20*b* in the form of the lateral surface of a frustum, so that the internal diameter of the entrance portion gradually reduces toward the inward side, in terms of the direction parallel to the axial line. In other words, the provision of this surface 20*b* enables the sealing member 2 to be smoothly inserted into the driving portion 20. Further, the driving portion 20 is provided with a pair of engagement ribs 20*a* for rotationally driving the developer supply container 1. These engagement ribs 20*a* are for hooking the engagement projections 3 to transmit the rotational driving force, after the insertion of the sealing member 2.

Next, referring to FIG. 14, how the driving portion 20 and sealing member 2 in this embodiment engage with each other will be described.

Figure 14:
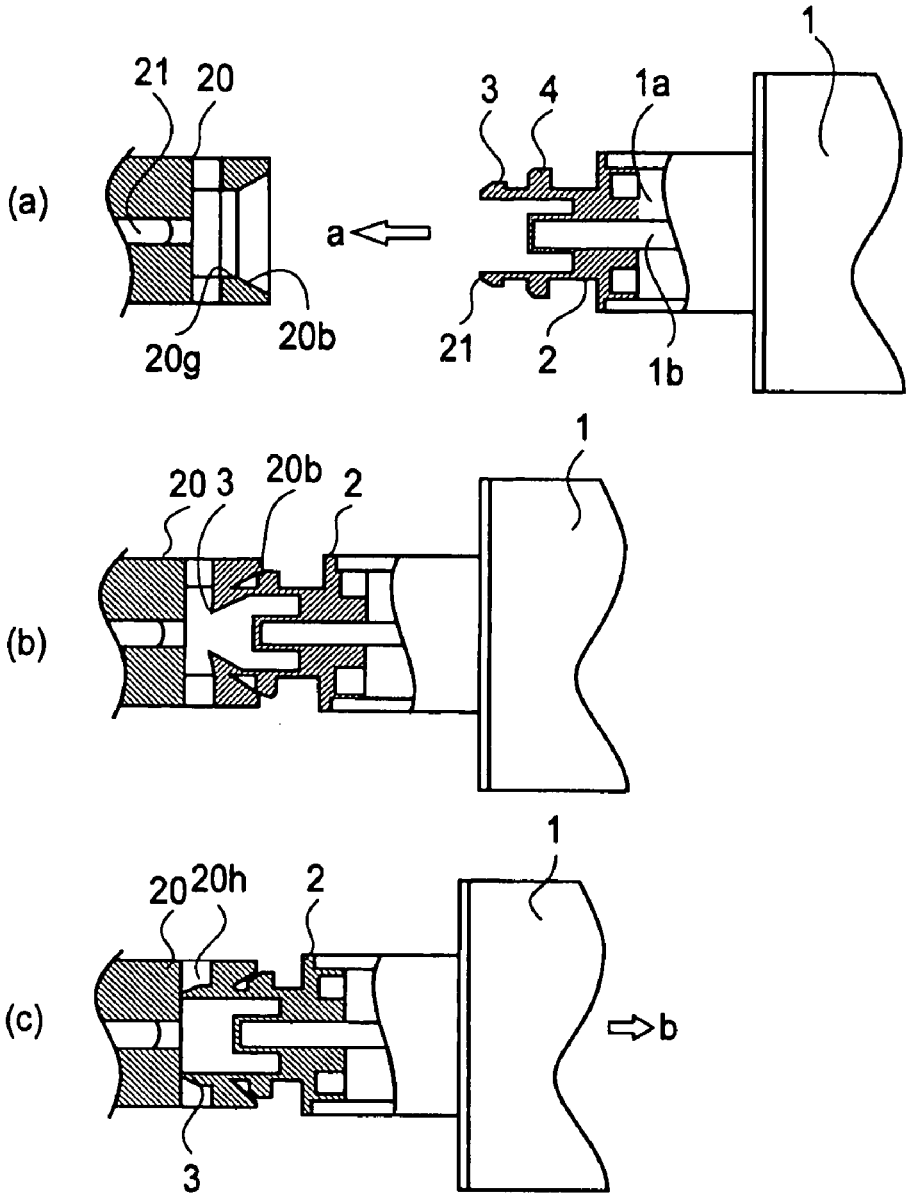
FIG. 14 is a sectional view showing the sequence in which the developer supply container is engaged with the driving force transmitting portion.

FIG. 14(*a*) shows the driving portion 20 of the apparatus main assembly 100, and the sealing member 2, and its adjacencies, of the developer supply container 1 which is being inserted into the apparatus main assembly 100 by a user to be set in the apparatus main assembly 100, prior to the engagement between the former and the latter. As the developer supply container 1 in the state shown in FIG. 14(*a*) is further inserted, the engagement projections 3 of the sealing member 2 come into contact with the conic surface 20*b* of the driving portion 20, as shown in FIG. 14(*b*). Then, as developer supply container 1 is further inserted, the engagement projections 3 enter the driving portion 20 while being guided by the conic surface 20*b*, being thereby gradually and resiliently displaced toward the axial line of the driving portion 20 (sealing member 2).

As the developer supply container 1 is further inserted, the engagement projections 3 move past the cylindrical portion 20*g* contiguous to the conic surface 20*b*, and as soon as the engagement projections 3 move past the cylindrical portion 20*g*, they are moved into one of the spaces 20*h* between the engagement ribs 20*a*, in terms of the circumferential direction of the driving portion 20, by the resiliency of the supporting portions 2*f*, allowing the supporting portions 2*f* to restore their normal shapes, causing therefore the engagement projections 3 to become engaged with the driving portion 20, as shown in FIG. 14(*c*). In this state, the engagement projections 3 are firmly engaged with the driving portion 20, fixing thereby the position of the sealing member 2 relative to the driving portion 2 in terms of the thrust direction (direction parallel to axial line).

Figure 16:
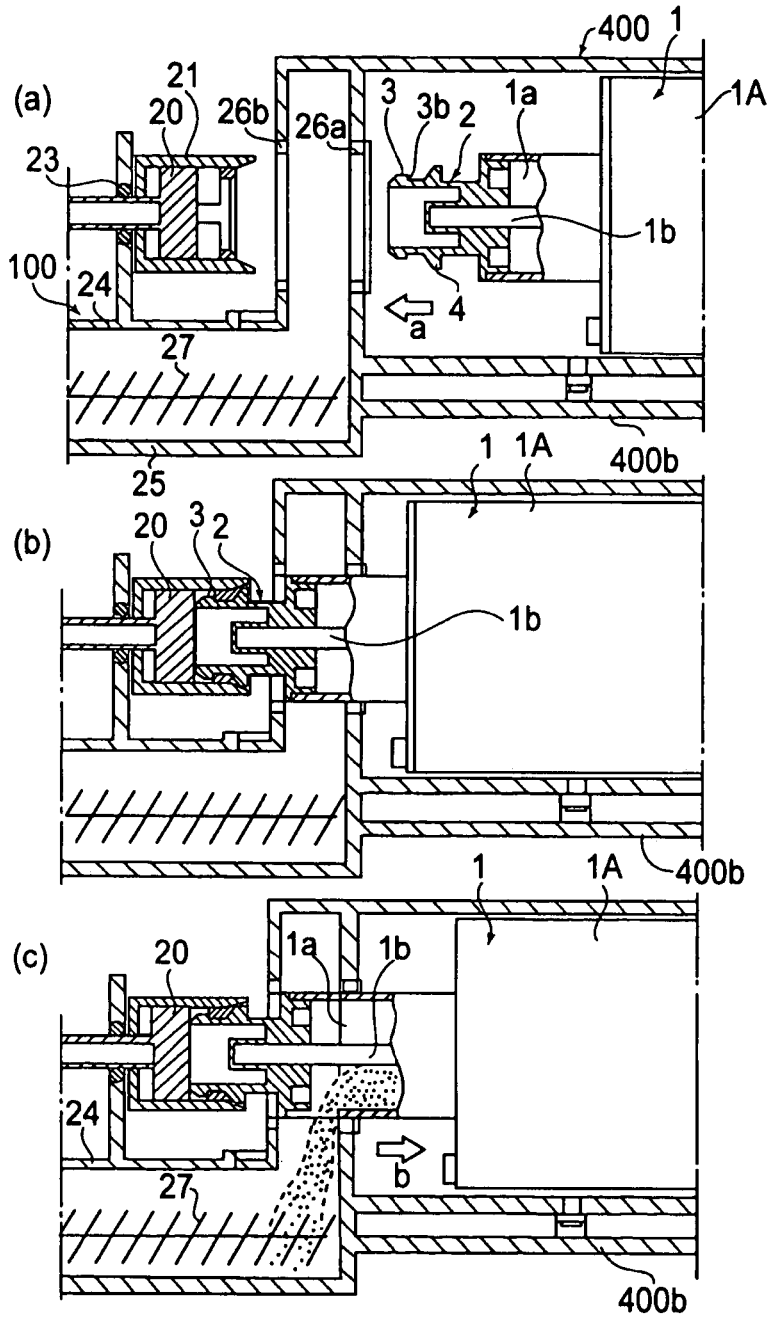
FIG. 16 is a drawing depicting the developer supplying operation of the developer supply container.

Therefore, even if the developer supply container 1 is retracted in the direction indicated by an arrow mark b as shown in FIG. 16(*c*), it does not occur that the sealing member 1 is retracted with the developer supply container 1; in other words, the sealing member 2 remains locked with the driving portion 20, and only the developer supply container 1 is retracted, ensuring that the sealing member 2 becomes separated from the developer supply container 1, unsealing thereby the outlet 1*a*. Incidentally, a structural arrangement may be made so that as the developer container replacement cover 15 of the apparatus main assembly 100 is opened or closed, the developer supply container 1 is slid by the movement of the cover 15, or the apparatus main assembly 100 may be provided with a motor dedicated to sliding the developer supply container 1. Further, the apparatus main assembly 100 may be provided with the rotatable lever 400*d* dedicated to sliding of the developer supply container 1 as it is in this embodiment. In other words, any method will suffice as long as it can slide the developer supply container 1 in direction in which the developer supply container 1 is to be retracted.

[Disengaging Method]

Next, referring to FIG. 15, the disengagement of the engagement projections 3 from the driving portion 20 of the apparatus main assembly 100 will be described.

Figure 15:
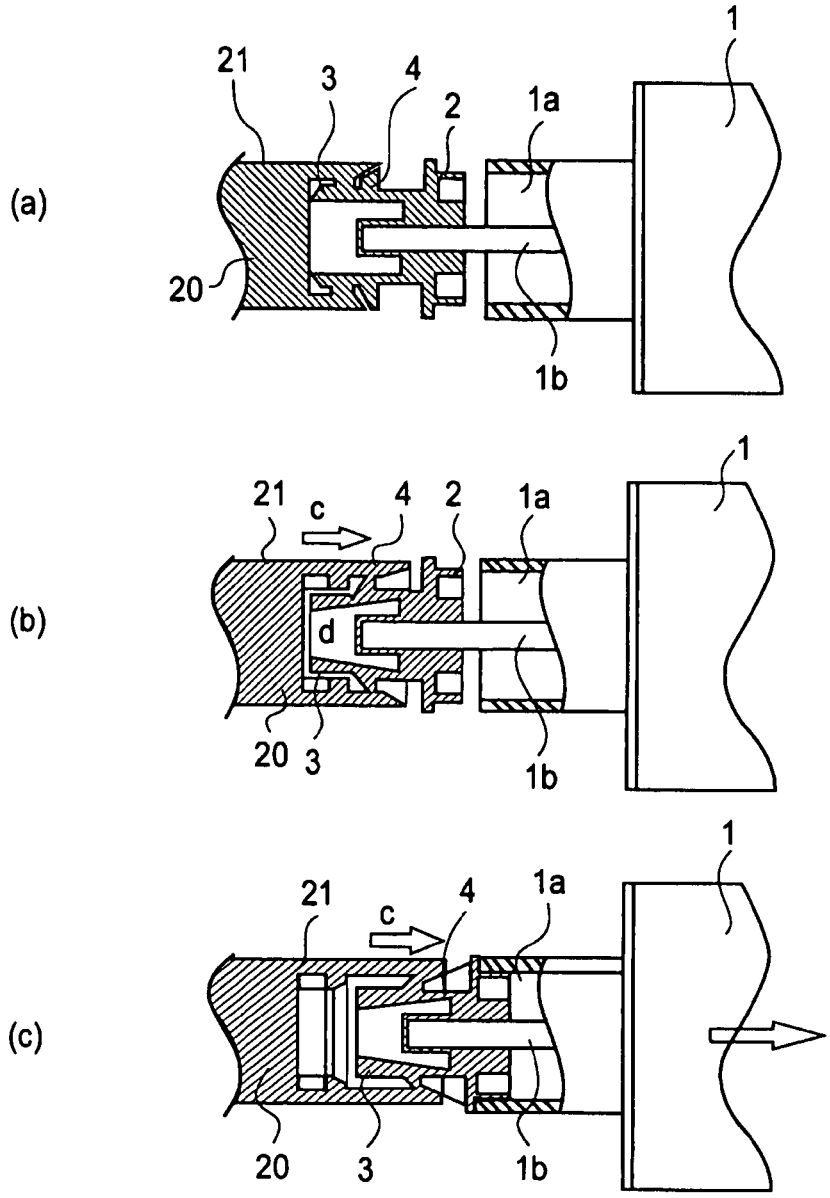
FIG. 15 is a sectional view showing the sequence in which the developer supply container is disengaged from the driving force transmitting portion.

FIG. 15(*a*) shows the state of the joint among the driving portion 20 of the apparatus main assembly 100, sealing member 2, and outlet 1*a* of the developer supply container 1, at the end of the process of supplying the apparatus main assembly 100 with developer when the outlet 1*a* of the developer supply container 1 has been unsealed. Referring to FIG. 15(*b*), in order to break the engagement between the driving portion 20 and sealing member 2, a pushing member 21 is to be moved in the direction indicated by an arrow mark c in FIG. 15(*b*) so that the cylindrical portion 20*g* of the internal surface of the pushing member 21 slides onto the disengagement portions 4, each of which is located roughly at the mid point of the sealing member 2 in terms of the thrust direction. As the pushing member 21 is moved in the above described fashion, the disengagement portions 4 are pressed toward the axial line of the sealing member 2 by the internal surface of the pushing member 21, displacing thereby toward the axial line, that is, in the direction indicated by an arrow mark d, along with the engagement projections 3 which also are integral parts of the supporting portions 2*f*, one for one, as are the disengagement portions 4. As a result, the engagement between the engagement projections 3 and the driving portion 20 of the apparatus main assembly 100 is broken.

Thereafter, the pushing member 21 is to be made to progress further in the direction indicated by an arrow mark c. As the pushing member 21 is made to progress further in the arrow c direction, the sealing member 2 is returned to the position in which it seals the developer supply container 1. Then, the pushing member 21 causes the developer supply container 1 itself to retract, that is, slide back to where the developer supply container 1 can be easily moved out of the apparatus main assembly 100 by a user. Regarding the structural arrangement for driving the pushing member 21, the movement of the pushing member 21 may be tied to the opening or closing movement of the developer supply container replacement cover 15 of the apparatus main assembly 100 as described before, so that the opening of the developer supply container replacement cover 15 causes the pushing member 21 to move in the direction indicated by the arrow mark c, causing thereby the driving portion 20 and the sealing member 2 of the developer supply container 1 to separate from each other, whereas the closing of the developer supply container replacement cover 15 causes the pushing member 21 to move in the direction opposite to the direction indicated by the arrow mark c. Instead, the developer supplying apparatus 400 may be provided with a motor dedicated to moving the pushing member 21 so that the operation for separating the driving portion 2 and sealing member 2 can be carried out independently from the opening or closing of the developer supply container replacement cover 15. Alternatively, the developer supplying apparatus 400 may be provided with rotatable lever 400*d* dedicated to slide the pushing member 21 so that the rotation of the lever 400*d* causes the pushing member 21 to slide in the direction to separate the driving portion 20 and sealing member 2 from each other. In other words, any method will suffice as long as it causes the pushing member 21 to slide in the direction to separate the driving portion 20 and sealing member 2 from each other. Incidentally, the pushing member 21 may be disposed within the driving portion 20 as shown in FIG. 14.

[Developer Supplying Operation]

Next, referring to FIGS. 16(*a*)-16(*c*), the operation for supplying the apparatus main assembly 100 with developer, with the use of the developer supply container 1 in this embodiment will be described.

FIGS. 16(*a*)-16(*c*) are drawings for sequentially showing the stages of the operation for supplying the apparatus main assembly 100 with developer by inserting the developer supply container 1 in this embodiment into the apparatus main assembly 100. As shown in these drawings, the apparatus main assembly 100 is provided with the developer supplying apparatus 400, which is provided with the driving portion 20 (driving force transmitting portion) which is to be connected to the developer supply container 1 to rotationally drive the developer supply container 1. The driving portion 20 is rotatably supported by a bearing 23, and is rotationally driven by an unshown motor disposed in the apparatus main assembly 100.

The apparatus main assembly 100 is also provided with a partitioning wall 25 which constitutes the wall of the developer supplying passage 24 (subordinate hopper) connected to the hopper 201*a*. To this partitioning wall 25, a bearing 26*a* (on inward side) and a bearing 26*b* (on outward side) for rotatably supporting the developer supply container 1 by a part of the developer supply container 1, and also, for hermetically sealing the developer supply passage 24 (subordinate hopper), is solidly embedded. Further, in the developer supply passage 24 (subordinate hopper), a screw 27 for conveying the developer supply to the hopper 201*a* is disposed.

In FIG. 16(*a*), the first stage of inserting the developer supply container 1 into the apparatus main assembly 100 is shown. The developer supply container 1 is provided with the developer supply outlet 1*a*, which is cylindrical in this embodiment and projects from one of the lengthwise end surfaces of the developer supply container 1. At the stage shown in FIG. 16(*a*), the opening of the outlet 1*a*, which is located at the end of the outlet 1*a*, remains sealed by the sealing member 2.

In FIG. 16(*b*), the next stage of the developer supply container insertion is shown, at which the engagement projections 3, which constitute the leading end portion of the sealing member 2, are fully engaged with the driving portion 20 of the apparatus main assembly 100. At this stage, the sealing member is locked with the driving portion 20, in terms of the movement in the thrust direction (direction parallel to axial line), by the engagement surface of each of the engagement projections 3 and the counterpart of the driving portion 20. Therefore, unless the sealing member 2 is unlocked from the driving portion 20, its positional relationship to the driving portion 20 remains unchanged.

In FIG. 16(*c*), the final stage of mounting of the developer supply container 1 is shown, at which the sealing member 2 and driving portion 20 have fully engaged with each other; the developer supply container tray 400*b* and developer supply container 1 have been made to retract by the rotation of the rotatable lever 400*d*, causing the sealing member 2 to separate from the developer supply container 1; and therefore, the outlet 1*a* has been unsealed, making it possible to supply the apparatus main assembly 100 with the developer. Further, it does not occur that the drive shaft 1*b* having been locked with the cylindrical portion 1A of the developer supply container 1 becomes completely disengaged from the sealing member 2; in other words, a part of the drive shaft 1*b* remains in the sealing member 2.

As for the cross-sectional shape of the drive shaft 1*b*, the drive shaft 1*b* is given a noncircular one, for example, square, triangular, or the like cross-sectional shape, to enable the drive shaft 1*b* to transmit rotational driving force. As the unshown motor is rotated at this stage, the rotational driving force from the motor is transmitted through the driving portion 20 of the apparatus main assembly 100 to the sealing member 2, from which it is transmitted to the drive shaft 1*b* to rotate the developer supply container 1. In other words, the sealing member 2 plays two roles: the role of sealing the developer supply container 1 and the role of transmitting the rotational driving force to the developer supply container 1. Further, since the developer supply container 1 is rotatably supported by the bearing 23 of the container tray 400*b*, it takes only a small amount of torque to rotate the developer supply container 1.

As the developer supply container 1 is rotated, the developer in the developer supply container 1 is gradually discharged through the outlet 1*a* into the developer supply passage 24, and is conveyed by the screw 27 in the developer supply passage 24 to the hopper 201*a* of the apparatus main assembly 100, from which the developer is delivered to the developing portion.

[Method for Replacing Developer Supply Container]

Next, the method for replacing the developer supply container in this embodiment will be described. With the progression of an image formation process, the developer in the developer supply container 1 is gradually consumed. As roughly the entirety of the developer in the developer supply container 1 is consumed, it is detected by a developer depletion detecting means (unshown) of the apparatus main assembly 100 that the developer supply container 1 has been depleted of the developer therein. This information is given to a user through a displaying means 100*b* (FIG. 2) such as a liquid crystal display. In this embodiment, the developer supply container 1 is to be replaced by a user, and the procedure therefor is as follows.

First, the developer supply container replacement cover 15 in the closed state is to be rotated about the hinge 18 to the position shown in FIG. 3. Then, the rotatable lever 400*d* (FIG. 4) is to be rotated. As the lever 400*d* is rotated, the developer supply container tray 400*b* is moved by the rotation of the lever 400*d*, causing the cylindrical portion 1A of the developer supply container 1 which is in the state shown in FIG. 16(*c*), to move in the direction indicated by the arrow mark a in FIG. 16(*a*). As a result, the sealing member 2, which has been in the position in which it remains separated from the cylindrical portion 1A of the developer supply container 1, that is, it keeps the outlet 1*a* of the developer supply container 1 unsealed, is pressed into the outlet 1*a*, sealing thereby the outlet 1*a*, as shown in FIG. 16(*b*).

Next, the user is to pull the developer supply container 1, which has been in the apparatus main assembly 100 and has been depleted of developer, in the direction opposite to the direction indicated by the arrow mark a in FIG. 16(*a*), in order to remove the developer supply container 1 from the apparatus main assembly 100. Thereafter, the user is to insert a brand-new developer supply container 1 into the apparatus main assembly 100 in the direction indicated by the arrow mark a in FIG. 16(*a*), rotate the rotatable lever 400*d*, and close the developer supply container replacement cover 15. Then, the rotatable lever 400*d* is to be rotated as described before. As the rotatable lever 400*d* is rotated, the developer supply container unsealing-sealing means is moved by the rotation of the rotatable lever 400*d*, causing the sealing member 2 to separate from the container proper 1A of the developer supply container 1, unsealing thereby the outlet 1*a* of the developer supply container 1 (FIG. 16(*c*)).

[Mix-up Prevention Structure]

What must be avoided by all means when replacing the developer supply container described above in detail is to accidentally set in the apparatus main assembly 100, a developer supply container, which contains developer different from the developer in the developer supply container to be replaced. In this embodiment, therefore, a structural arrangement is provided, which prevents a wrong developer supply container from being accidentally set. Next, this structural arrangement for preventing the problem that a developer supply container depleted of the developer therein is replaced with a wrong developer supply container will be described with reference to drawings.

Figure 17:
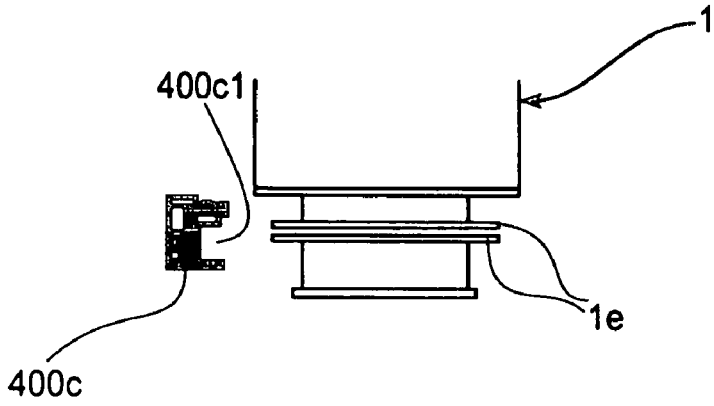
FIG. 17 is a drawing of the structural arrangement for preventing the mounting of a wrong developer supply container.
Figure 17:
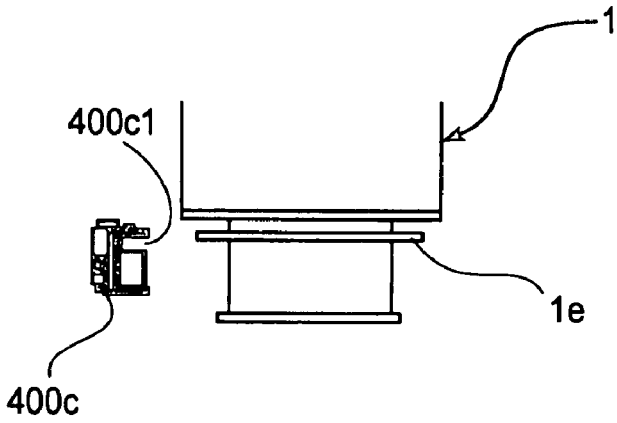

Referring to FIG. 17, the developer supply container 1 is provided with one or more identification projections 1*e*, which project from the rear end portion (opposite portion of developer supply container 1 from outlet 1*a*, in this embodiment, in FIG. 7) of the container proper of the developer supply container 1. Each identification projection 1*e* is in the form of a ring, and the number of the identification projections and their intervals are differentiated according to the color, or type, of the developer in each developer supply container 1.

As for the developer supplying apparatus 400, it is provided with the developer supply container compatibility checking member 400*c* for rejecting a wrong developer supply container, or a developer incorrect in color or type of the developer therein, as shown in FIG. 17. The compatibility checking member 400*c* is provided with a notch 400*c*1 (even if compatibility checking member 400*c* has a recess formed as an integral part of compatibility checking member 400*c*, the recess will be referred to as notch). The notch 400*c*1 is given such a shape that matches only the identification projection 1*e*, with which a developer supply container containing the developer identical in color and type to the developer used by the main assembly 100 of the image forming apparatus, is provided.

Thus, if an attempt is accidentally made to mount a wrong developer supply container, that is, a developer supply container 1 containing the developer which does not match the developer used by the main assembly 100 of the image forming apparatus, by setting the wrong container in the developer supply container tray 400*b*, the abovementioned notch 400*c*1 does not match the identification projection 1*e* of the developer supply container, interfering thereby the mounting of the developer supply container. On the other hand, if an attempt is made to mount a correct developer supply container, that is, a developer supply container containing the developer which does match the developer used by the main assembly 100 of the image forming apparatus by setting the developer supply container 1 in the main assembly 100 of the image forming apparatus, the abovementioned notch 400*c*1 matches the identification projection 1*e*, not interfering therefore with the mounting of the correct developer supply container 1.

In other words, it is made possible, by the combination of the identification projection 1*e* of the developer supply container 1 and the notch 400*c*1, to determine whether or not a given developer supply container 1 is mountable in the apparatus main assembly 100.

Referring to FIG. 5, which is a perspective view of the developer supplying apparatus 400, and the developer supply container 1 to be mounted into the developer supplying apparatus 400 as described before, a user is to insert the developer supply container 1, which is in the state shown in FIG. 5, into a predetermined location (shown in FIG. 6(*a*)) in the direction indicated by an arrow mark. Then, the user is to rotate the rotatable lever 400*d* to complete the process of mounting the developer supply container 1 (FIG. 6(*b*)).

The rotation (in the direction indicated by arrow mark B in FIG. 4) of the rotatable lever 400*d* causes the compatibility checking member 400*c* to rotate toward the identification projection 1*e* of the developer supply container 1 (that is, direction indicated by arrow mark C in FIG. 4). Thus, when a developer supply container compatible with the apparatus main assembly 100 is mounted, that is, when the compatibility checking projection 1*e* and notch 400*c*1 match each other, the rotatable lever 400*d* is rotatable all the way, allowing the developer supply container to be mounted.

On the other hand, if a developer supply container incompatible with the apparatus main assembly 100 is mounted, that is, when the compatibility checking projection 1*e* and notch 400*c*1 do not match each other, the compatibility check projection 1*e* interferes with the rotation of the compatibility checking member 400*c* with the notch 400*c*1, preventing the rotatable lever 400*d* from being rotated all the way. Therefore, the developer supply container 1 cannot be mounted.

Therefore, the operation itself carried out to replace the developer supply container in the developer supplying apparatus 400 ensures that a developer supply container matching the apparatus main assembly is mounted.

During the operation for supplying the apparatus main assembly 100 with developer, the developer supply container 1 rotates by receiving the driving force, causing sometimes the projection 1*e* to rub against the internal surfaces of the notch 400*c*1. In this embodiment, therefore, the portions of the notch 400*c*1, on which the identification projection 1*e* slide, are provided with a slippery member to prevent the internal surfaces of the notch 400*c*1, and the identification projection 1*e*, from being shaved away by friction. As for the material for the slippery member, a sheet of high polymer polyethylene, or the like, is preferable, and may be pasted to the internal surfaces of the notch 400*c*1.

The above described structural arrangement, that is, the combination of the identification projection 1*e* and the notch 400*c*1 of the compatibility checking member 400*c*, is simple and inexpensive, and yet, ensures that only a developer supply container containing such a developer that matches the developer used by the apparatus main assembly 100 is mounted into the developer supplying apparatus 400.

Further, the compatibility checking member 400*c*, identification projection 1*e*, etc., are disposed the most upstream side in terms of the developer supply container mounting direction, that is, on the user side. Therefore, a user can see the progression of the process of mounting the developer supply container 1, making it thereby easier for the use to carry out the aforementioned phase synchronization. Should a user accidentally set a wrong developer supply container in the developer supply container tray 400*b* to mount the container into the apparatus main assembly 100, the user will be quickly informed of the error.

Further, when removing the developer supply container 1, it is unnecessary to align the compatibility check member 400*c* of the developer supplying apparatus 400, with the identification projection 1*e* of the developer supply container 1. In other words, a user can smoothly remove the developer supply container 1 by simply pulling the developer supply container 1. In other words, this embodiment of the present invention substantially improves an image forming apparatus in ease of operation and operational efficiency.

Further, in order to improve an image forming apparatus in ease of operation and operational. efficiency without employing the structural arrangement in this embodiment, it is necessary to provide the developer supplying apparatus 400 with a means for regulating the developer supply container 1 in terms of the rotation of the developer supply container 1. However, the employment of a structural arrangement such as the one in this embodiment eliminates the need for the means for regulating the developer supply container 1 in terms of its rotation, making it thereby possible to reduce the main assembly 100 of an image forming apparatus in size and cost.

According to the structural arrangement, in this embodiment, for a developer supplying apparatus, if an attempt is accidentally made to mount a developer supply container of a wrong type, it does not occur that the wrong developer supply container is completely mounted into the developer supplying apparatus 400; in other words, it does not occur that the sealing member 2, which has been keeping the outlet 1*a* of the developer supply container 1 sealed, engages with the driving portion 20 of the developer supplying apparatus 400. Therefore, it does not occur that the wrong developer supply container 1 is accidentally unsealed, or the driving force from the apparatus main assembly 100 is accidentally transmitted to the wrong developer supply container 1. Therefore, it is ensured that the problem that a developer of a wrong type is supplied to the main assembly of an image forming apparatus is prevented.

Further, the structural arrangement in this embodiment requires a user to operate the rotatable lever 400*d* when mounting the developer supply container 1. However, when a wrong developer supply container 1 is in the developer supply container tray 400*b*, an attempt to rotate the lever 400*d* will fail, that is, the lever 400*d* cannot be operated, because the developer supply container 1 interferes with the rotation of the lever 400*d*. Therefore, it is further ensured that a problem such as the above described one will not occur.

Further, in this embodiment, the developer supply container tray 400*b* and compatibility checking member 400*c* are moved by the rotation of the rotatable lever 400*d* as a rotatable member. However, the rotatable member does not need to be limited to a lever. For example, a structural arrangement is made so that not only is the developer supply container tray 400*b* moved forward or backward by the rotational movement of the developer supply container replacement cover 15, but also, the compatibility checking member 400*c* is rotated by the rotational movement of the cover 15. The effects of such a structural arrangement are the same as those of the structural arrangement in this embodiment.

The employment of the above described structural arrangement eliminates the need for providing the main assembly of an image forming apparatus, or the like, with a conventional mechanism or the like for preventing the main assembly from being supplied with wrong developer, making it possible to provide an image forming apparatus main assembly, which is smaller in size, lower in cost, and higher in reliability level than that in accordance with the prior art.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 260583/2004 filed Sep. 8, 2004 which is hereby incorporated by reference.

What is claimed is:

1. A developer supply apparatus comprising:

a container receiving portion configured and positioned to receive a developer supply container, said container receiving portion being movable between a container mounting and demounting position and a developer supply position while carrying a developer supply container containing a developer to be supplied;

a moving mechanism configured and positioned to move said container receiving portion between the container mounting and demounting position and the developer supply position by a manually operable lever;

a mounting discrimination member provided on said container receiving portion so as to be movable together with said container receiving portion and operatively connected with said lever and provided for relative movement between said mounting discrimination member and a portion to be discriminated provided on said developer supply container in interrelation with a moving operation of said lever, wherein when said mounting discrimination member makes the relative movement to reach a regular position, said container receiving portion moves to the developer supply position, and when said mounting discrimination member makes the relative movement, and said mounting discrimination member interferes with said portion to be discriminated before said mounting discrimination member reaches the regular position, said container receiving portion is prevented from moving to said developer supply position.

2. An apparatus according to claim 1, wherein said mounting discrimination member is rotatably mounted on said container receiving portion.

3. An apparatus according to claim 1, wherein said mounting discrimination member is disposed at such a position that it is visible when said developer supply container is at the developer supply position.

4. An apparatus according to claim 1, wherein said mounting discrimination member is provided with a recess in a region opposing to said portion to be discriminated, and when said recess does not interfere with the portion to be discriminated, said mounting discrimination member is movable to the regular position, and said container receiving portion is movable to the developer supply position.

5. An apparatus according to claim 4, wherein the recess is provided with a sliding member.

6. An apparatus according to claim 1, wherein said container receiving portion is effective to support said developer supply container so as to face a toner supply opening of said developer supply container toward the developer supply position.

* * * * *